US011589639B2

(12) United States Patent
Willis

(10) Patent No.: US 11,589,639 B2
(45) Date of Patent: Feb. 28, 2023

(54) LIGHT SYMBOL PROJECTION DEVICE

(71) Applicant: John C. Willis, Chicago, IL (US)

(72) Inventor: John C. Willis, Chicago, IL (US)

( * ) Notice: Subject to any disclaimer, the term of this patent is extended or adjusted under 35 U.S.C. 154(b) by 0 days.

(21) Appl. No.: 17/588,325

(22) Filed: Jan. 30, 2022

(65) Prior Publication Data

US 2022/0264989 A1 Aug. 25, 2022

Related U.S. Application Data

(60) Provisional application No. 63/152,511, filed on Feb. 23, 2021.

(51) Int. Cl.

| | |
|---|---|
| ***A43B 3/36*** | (2022.01) |
| ***F21V 23/04*** | (2006.01) |
| ***F21V 17/10*** | (2006.01) |
| ***F21V 9/40*** | (2018.01) |
| ***H04R 3/00*** | (2006.01) |
| ***H04R 1/02*** | (2006.01) |
| ***F21V 17/00*** | (2006.01) |
| ***F21W 121/06*** | (2006.01) |

(52) U.S. Cl.

CPC ..... *A43B 3/36* (2022.01); *F21V 9/40* (2018.02); *F21V 17/002* (2013.01); *F21V 17/105* (2013.01); *F21V 23/0435* (2013.01); *H04R 1/028* (2013.01); *H04R 3/00* (2013.01); *F21W 2121/06* (2013.01)

(58) Field of Classification Search

CPC ..... A43B 3/36; F21V 23/0435; F21V 17/002; F21V 17/105; F21V 9/40; H04R 3/00; H04R 1/028

See application file for complete search history.

(56) References Cited

U.S. PATENT DOCUMENTS

| | | | | |
|---|---|---|---|---|
| 5,644,858 A * | 7/1997 | Bemis | A43B 3/34 36/137 |
| 2006/0104047 A1* | 5/2006 | Guzman | A43B 3/36 362/103 |
| 2011/0308113 A1* | 12/2011 | Hartford | A43B 3/36 36/136 |
| 2021/0298406 A1* | 9/2021 | Twombly | A43B 1/0054 |

* cited by examiner

*Primary Examiner* — Thomas M Sember
(74) *Attorney, Agent, or Firm* — Justin Lampel

(57) ABSTRACT

A light symbol projection device is disclosed. The light symbol projection device has a housing which is temporarily secured within a receiving mechanism. The receiving mechanism is embedded within a product such as, for example, a shoe. The light symbol housing may project, in various colors, a word, pattern, symbol, logo or other indicia on the ground. The light symbol housing may be interchangeable so that the receiving mechanism may receive various light symbol housings having different light projections. In one embodiment, a speaker associated with the device may also provide an audible sound.

13 Claims, 6 Drawing Sheets

LIGHT SYMBOL PROJECTION DEVICE

CROSS REFERENCE TO RELATED APPLICATIONS

The following application is a based on and claims the priority benefit of U.S. provisional application Ser. No. 63/152,511 filed Feb. 23, 2021 currently co-pending; the entire content of which is incorporated by reference.

BACKGROUND OF THE INVENTION

A light symbol projection device is disclosed. The light symbol projection device has a housing which is temporarily secured within a receiving mechanism. The receiving mechanism is embedded within a product such as, for example, a shoe. The light symbol housing may project, in various colors, a word, pattern, symbol, logo or other indicia on the ground. The light symbol housing may be interchangeable so that the receiving mechanism may receive various light symbol housings having different light projections. In one embodiment, a speaker associated with the device may also provide an audible sound.

Light projection devices for shoes are known. For example, U.S. Pat. No. 8,650,777 to Hsu discloses an illuminant shoe having a body, an outsole and an illuminating device. The body has a putting segment, a lifting cover and an insole. The putting segment has a heel lining and a through hole. The lifting cover is connected to the heel lining. The insole is mounted in the putting segment. The outsole is mounted on the putting segment and has a mounting chamber. The illuminating device is mounted in the mounting chamber and has an illuminating module, a controlling module and a switch. The illuminating module has first wires, multiple illuminating elements and a first electrical element. The controlling module is connected to the illuminating module and has two second electrical elements, multiple second wires, a controlling unit, a battery and a protecting casing. The switch is mounted in the putting segment, is connected to the controlling module and has a third wire and a third electrical element.

Further, U.S. Pat. No. 5,865,523 Chien discloses an illumination arrangement for a shoe having a D.C. power supply, a DC-AC inverter, and an electro-luminescent element which can be mounted on a surface of an upper portion of the shoe, or with a transparent area of the bottom portion of the shoe. The DC power supply and DC-AC inverter may be mounted in the bottom of the shoe.

Still further, U.S. Pat. No. 5,508,899 to McCormick discloses an attachment for a shoe or boot having a wishbone or spur element that fits around the quarters (or foxing or outer counter portion, depending upon its construction) of the shoe or boot. The element carries lamps that are visible when viewed toward the back of the shoe. The lamps are electrically connected to a source of current, generally a battery, which is carried either by the element itself, or by a casing to which the element is adjustably attached. The wishbone or spur element is preferably mounted by or aided in its mounting by a hook and loop fastener of the type sold under the trademark VELCRO.

However, these patents fail to describe a light symbol projection device which is easy to use. Further, these patents fail to provide for an effective light symbol projection device which is secured to a shoe and which projects an image on the ground.

SUMMARY OF THE INVENTION

A light symbol projection device is disclosed. The light symbol projection device has a housing which is temporarily secured within a receiving mechanism. The receiving mechanism is embedded within a product such as, for example, a shoe. The light symbol housing may project, in various colors, a word, pattern, symbol, logo or other indicia on the ground. The light symbol housing may be interchangeable so that the receiving mechanism may receive various light symbol housings having different light projections. In one embodiment, a speaker associated with the device may also provide an audible sound.

An advantage of the present light symbol projection device is that the present light symbol projection device may allow a user to display a symbol on the ground from, for example, a light secured to a pair of shoes.

Another advantage of the present light symbol projection device is that the present light symbol projection device may have a receiving mechanism for allowing a user to interchange the light symbol housing therein changing the light symbol image displayed on the ground.

Still another advantage of the present light symbol projection device is that the present light symbol projection device may provide increased safety for the wearer of a pair of shoes by making the wearer more visible at night.

And yet another advantage of the present light symbol projection device is that the present light symbol projection device may use powerful LED lights of various colors.

Another advantage of the present light symbol projection device is that the present light symbol projection device may have a remote for allowing a user to control the light symbol projection device.

In yet another embodiment, in one embodiment, the light symbol projection device may have an accompanying speaker which plays an audible sound with the light.

For a more complete understanding of the above listed features and advantages of the light symbol projection device reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A light symbol projection device is disclosed. The light symbol projection device has a housing which is temporarily secured within a receiving mechanism. The receiving mechanism is embedded within a product such as, for example, a shoe. The light symbol housing may project, in various colors, a word, pattern, symbol, logo or other indicia on the ground. The light symbol housing may be interchangeable so that the receiving mechanism may receive various light symbol housings having different light projections. In one embodiment, a speaker associated with the device may also provide an audible sound.

Referring now to the figures, in an embodiment, a light symbol projection device 1 is provided wherein the device includes a light emitting source. The light symbol projection device 1 is especially suitable for use in connection with a shoe 20; although, it should be understood that the present light symbol projection device 1 may be used with other items such as, but not limited to, skateboards, in-line skates, roller skates, bicycles, hoverboards, etc. For illustrative purposes FIGS. 1-3 and 5 illustrate a portion of the light symbol projection device 1 extending slightly below the bottom of the shoe sole 21; however, it should be known that the bottom of the light symbol projection device 1 may remain flush with or even higher up than the bottom of the shoe sole 21 so that no portion of the light symbol projection device 1 is visible from the side of the shoe 20.

Figure 1:
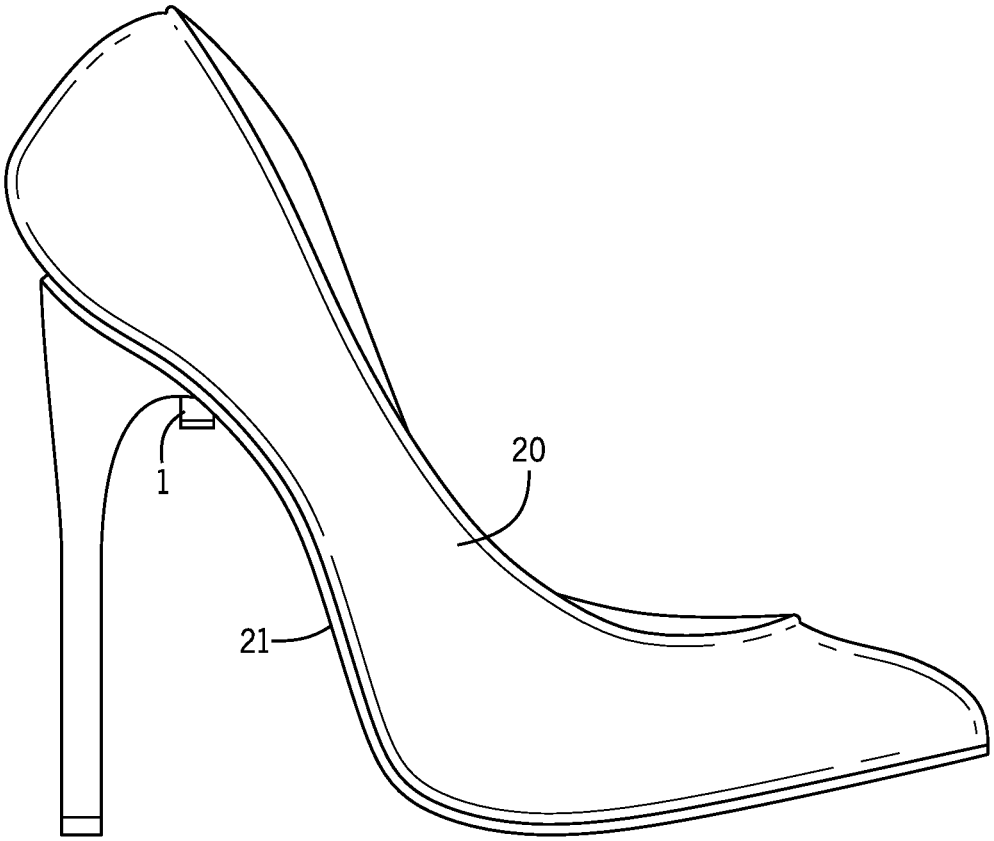
FIG. 1 illustrates a side view of a shoe having the light symbol projection device in one embodiment.
Figure 2:
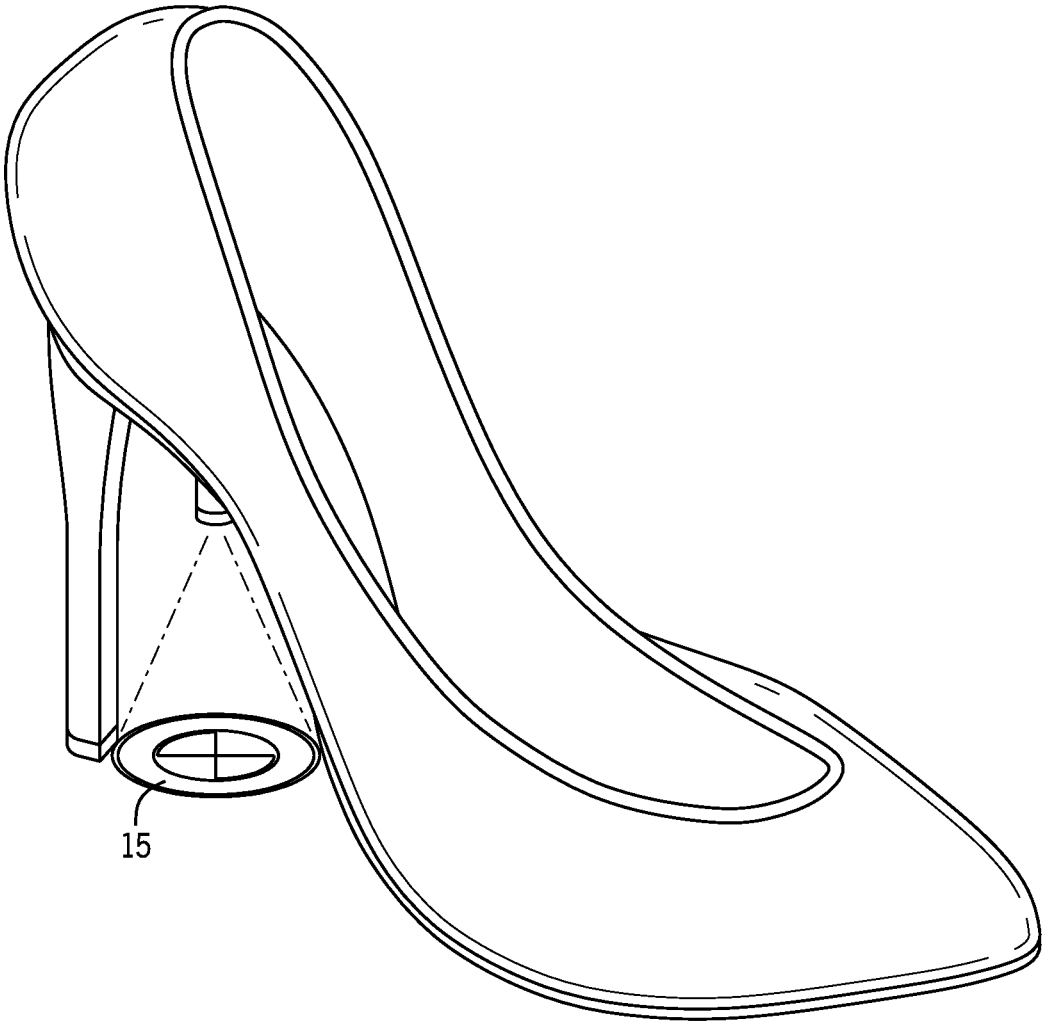
FIG. 2 illustrates a perspective view of the light symbol projection device projecting a light image on the ground in one embodiment.
Figure 3:
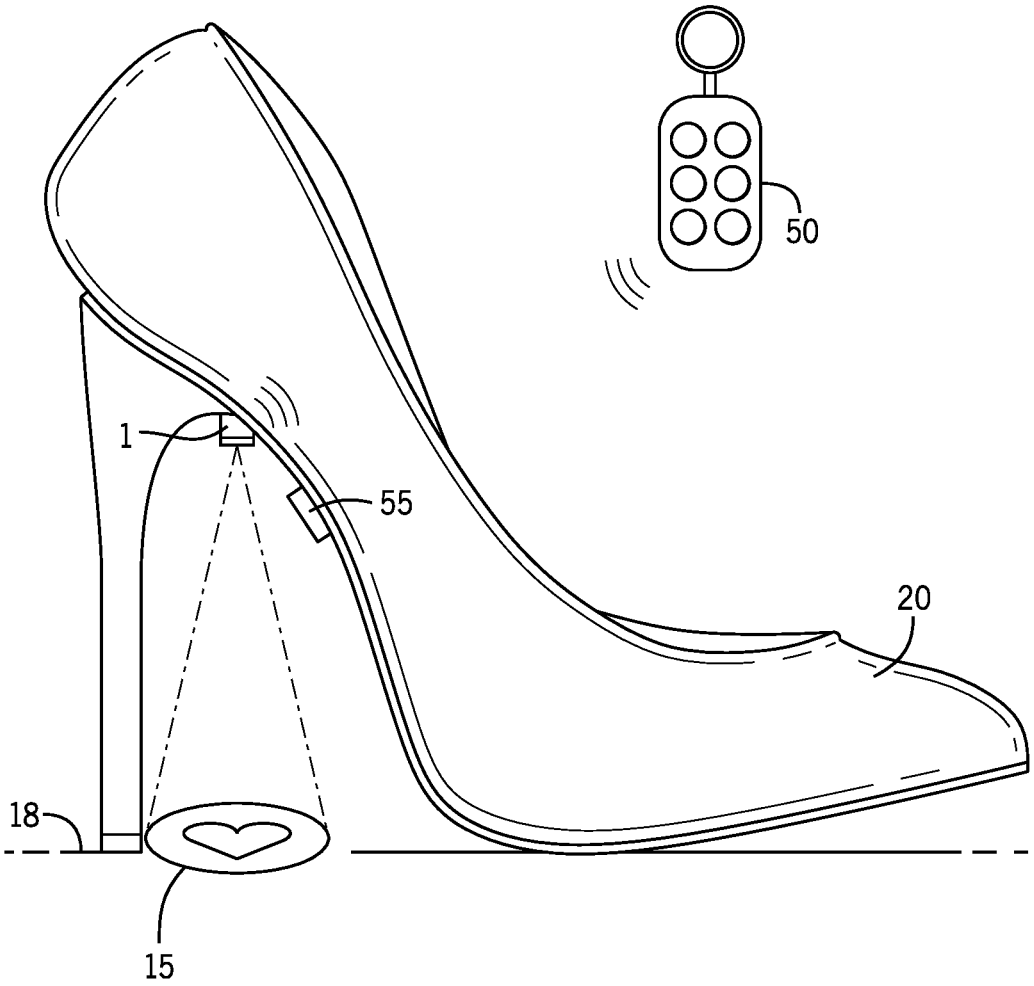
FIG. 3 illustrates a side view of the light symbol projection device wherein a remote control is provided for the user to control the light symbol projection device.

The present light symbol projection device 1 is preferably secured to the bottom (or sole) 21 of a shoe 20; however, it should be understood that the present device 1 may also be incorporated on the side and/or sole of a shoe 20 for non-high heal shoes. The present device 1, when turned on, may emit a light symbol 15 on the ground 18. FIG. 2 illustrates the light symbol as an "X" and FIG. 3 illustrates the light symbol as a heart. It should be understood that the actual projected light symbol 15 which is projected on the ground 18 is unlimited in scope and may be, for example, trademarks, logos, words, symbols, color patterns, etc and that the selected images shown in FIGS. 2 and 3 are merely for illustrative purposes only.

Referring now to FIG. 3, in one embodiment, a remote control 50 may be used to allow the wearer of the shoe 20 to control the light symbol projection device 1 without the wearer needing to reach down and touch his/her shoes 20 to activate/control the device 1. Instead, the remote 50 may be attached to, for example, a key chain for easy access. In particular, the remote 50 may allow the user to, for example, turn the device 1 on or off, select between flashing or not flashing images, select the colors displayed, rotate the image, control sound, select timed intervals of on and off, etc. In an embodiment, the remote 50 may be simply an app installed on a user's cell phone or computer that allows a user to control the device 1. The remote control 50 is wirelessly connected to a computer processing unit located within the light symbol projection device 1.

In one alternative embodiment of the device 1, a speaker 55 located on the shoe 20 may also produce an audible sound which may accompany and may be in sync with the projection image of the light symbol 15 on the ground 18. FIG. 3 illustrates the speaker 55 slightly extending from the bottom of the shoe 20, however, in an embodiment, the speaker 55 may remain flush with the bottom of the shoe 20 or even completely located within the shoe 20. The speaker 55 may also be controlled by the same remote 50 or cell phone as the light portion of the device 1.

Figure 4:
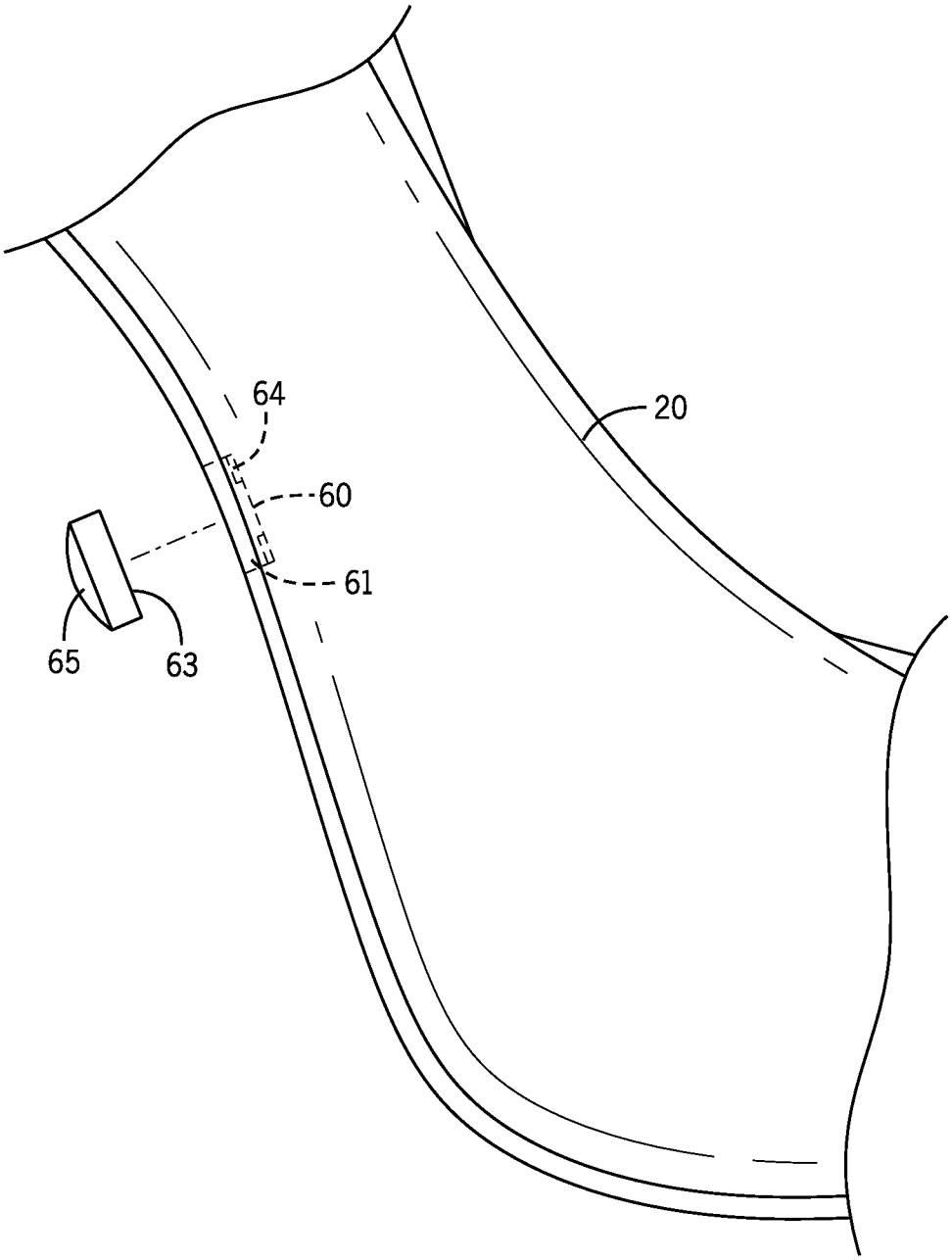
FIG. 4 illustrates an alternative embodiment of the light symbol projection housing unit and receiving mechanism of the shoe. In this figure, for illustrative purposes only, the light projection device is shown located at the same location as the speaker of FIG. 3 was shown.
Figure 5:
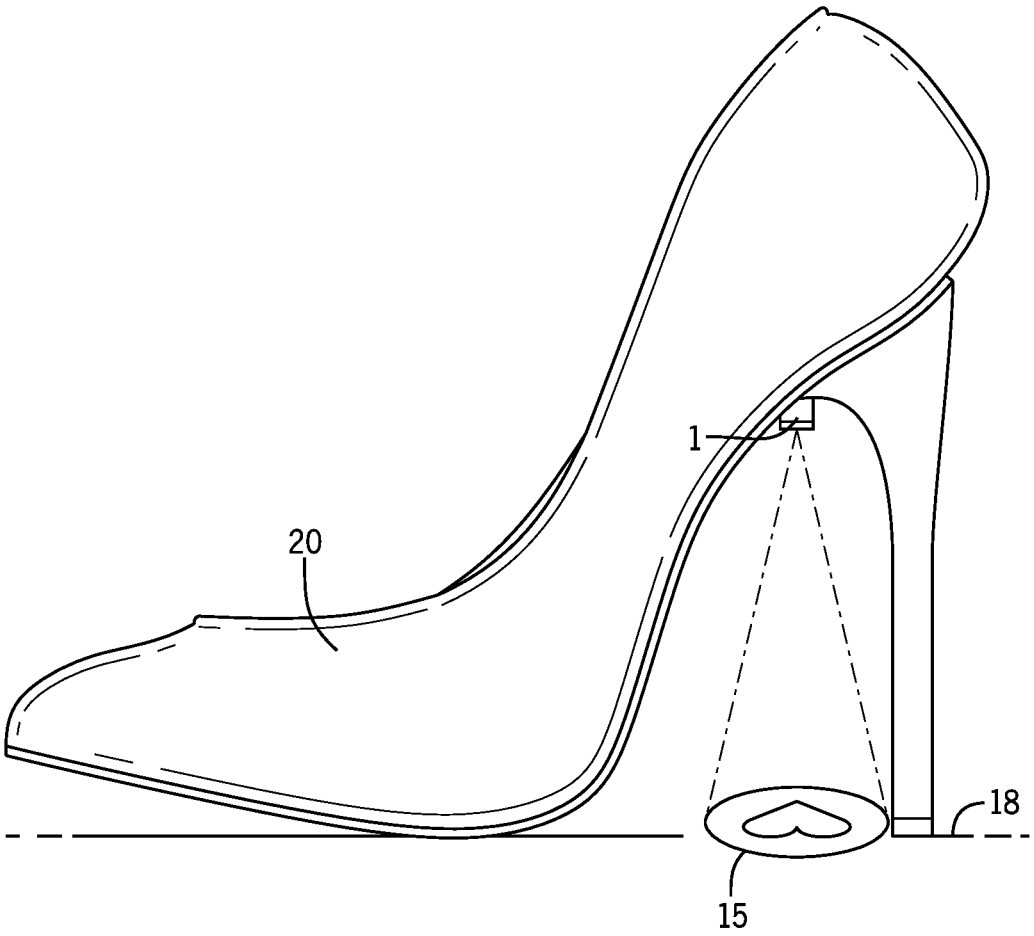
FIG. 5 illustrates an alternative perspective of the light symbol projection device displaying an image on the ground.

Referring now to FIG. 4, an alternative embodiment of the design is shown. In this embodiment, a receiving mechanism 60 may be located within the shoe 20. The receiving mechanism 60 may be permanently attached and located within the shoe 20 in an embodiment. The receiving mechanism 60 may have an interior opening 61 having a shape wherein the receiving mechanism 60 receives an interchangeable light emitting element 65 of substantially the same shape (such as a "cap"). The light emitting element 65 may produce a light image and may be removably and selectively engaged with the interior opening 61 of the receiving mechanism 60 so that a user may swap out different light emitting elements 65 to display different symbol images 15 on the ground 18 during use.

A battery may be located within the light emitting element 65 to power the light. The battery may be a single use battery or a rechargeable battery which may receive power from connecting to, for example, a USB port or an outlet. Preferably, the light is an LED light; however, alternative light sources may be used. In one embodiment, the back 63 of the light emitting device 65 is magnetic which is attracted to a second magnet 64 of the interior of the receiving mechanism 60 (or the magnetic back 63 may be attracted to a magnet 64 located in the shoe itself) so that the light emitting element 65 remains secured (but electively removable) within the receiving mechanism 60 by magnetic forces. Alternative means to secure the light emitting element 65 to the receiving mechanism 60 include use of a screw or a snap lock. In an embodiment, an import plug may be embedded within the shoe or device 1 which allows a user to charge the device 1 without the need to replace the internal battery 180. In the rechargeable embodiment, a user may never need to remove the housing from the receiving mechanism.

In an embodiment, a lens may be temporarily secured to or within the device 1 so that only the lens (which may have different symbols, words, etc) may be swapped out in order to change the displayed image 15 on the ground 18.

Figure 6:
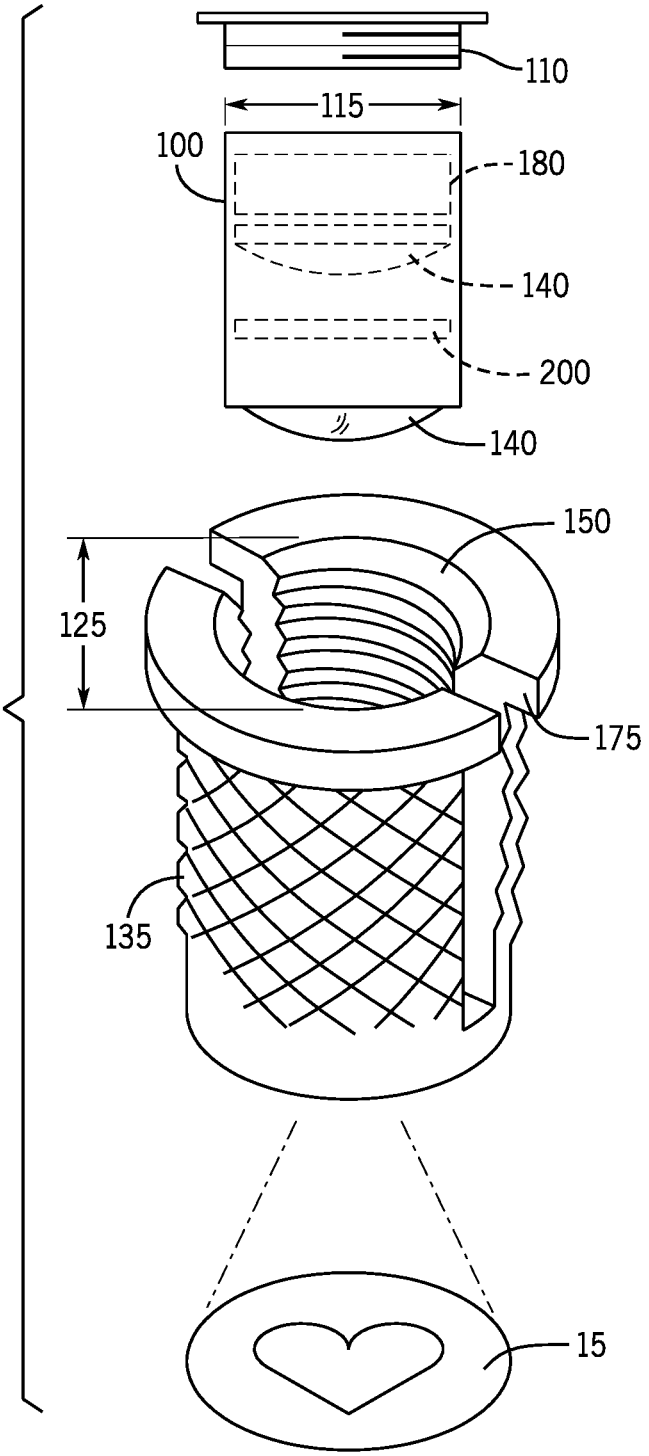
FIG. 6 illustrates an exploded view, in one embodiment, of the receiving mechanism receiving the light symbol projection device housing.

FIG. 6 illustrates an alternative embodiment of the light emitting device 1. In particular, in this embodiment, a housing 100 is more "bullet-shaped" as opposed to the cap-shape design of FIG. 4. In this alternative embodiment, the light emitting device 1 has a cylindrical housing 100 and a top 110. The cylindrical housing 100 further has a diameter 115 which is slightly less than a diameter 125 of an optional holding device 135 so that the cylindrical housing 100 may be temporarily and selectively secured within the optional holding device 135. The optional holding device 135 may then be inserted within the shoe 20. Located within the interior of the housing 100 may be a removable battery 180 and at least one lens 140. In an embodiment, an interchangeable image insert disc 200 may also located within the housing 100 wherein the image disc 200 may further have an image print to be displayed on the ground. Electively using both the image disc 200 and a lens 140 (with or without an image) may provide more realistic images being displayed on the ground, including 3D images.

To swap out a first cylindrical housing 100 from the shoe 20 in this embodiment of FIG. 6, a user may, for example, first remove both the housing 100 and the optional holding device 135 from the shoe 20 by, for example, unscrewing the holding device 135 from a receiving mechanism (not shown in FIG. 6) permanently embedded within the shoe 20 or by separating magnets as similarly stated above with respect to FIG. 4. Further, a user may slightly bend the optional holding device 135 by use of at least one slit 175 to release the housing 100 from an opening 150 of the optional holding device 135. An alternative cylindrical housing 100 of the same size and shape may then be reinserted into the opening 150 of the optional holding device 135 and the entire device 1 reinserted into the shoe 20 to display a different image 15 on the ground once activated.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A light symbol projection device comprising:

a light source located within an interior housing unit;

a battery electrically connected to the light source;

wherein the light source projects an image on the ground;

wherein the interior housing unit is located within a shoe;

a securing mechanism embedded within the shoe wherein the securing mechanism has an opening for receiving the interior housing unit having the light source; and a lens located within the interior housing unit wherein the lens has an image on it wherein the image is projected on the ground;

an interchangeable image insert disc located in the interior housing unit wherein the interchangeable image disc has an image on it and wherein the image is projected on the ground; and wherein using both the lens and the interchangeable image disc together creates a three-dimensional image on the ground.

2. The light symbol projection device of claim 1 further comprising:

a securing mechanism embedded within the shoe wherein the securing mechanism has an opening for receiving the interior housing unit having the light source.

3. The light symbol projection device of claim 2 wherein the interior housing unit is removably attached to the securing mechanism.

4. The light symbol projection device of claim 2 further comprising:

at least one slit on a side of the securing mechanism wherein the slit allows the securing mechanism to slightly expand a diameter of the securing mechanism to receive the interior housing unit.

5. The light symbol projection device of claim 1 further comprising:

a remote control wherein the remote control wirelessly controls the light source.

6. The light symbol projection device of claim 5 wherein the remote control is a cell phone.

7. The light symbol projection device of claim 1 further comprising:

a first magnet located on a bottom of the interior housing unit and a second magnet embedded within the shoe or receiving mechanism wherein the first magnet and the second magnet are attracted to each other and wherein the first magnet and second magnet secure the interior housing unit within the shoe.

8. The light symbol projection device of claim 1 further comprising:

a speaker associated with the light source wherein the speaker makes an audible sound and wherein the speak is controlled by a remote.

9. The light symbol projection device of claim 8 wherein the audible sound and the image may be synced together.

10. The light symbol projection device of claim 1 further comprising:

a lens located within the interior housing unit wherein the lens has an image on it wherein the image is projected on the ground.

11. The light symbol projection device of claim 1 wherein a lens is interchangeable with a second lens having an alternative image.

12. The light symbol projection device of claim 1 wherein the housing unit remains flush with respect to a sole of a bottom of the shoe.

13. A light symbol projection device comprising:

a light source located within an interior housing unit;

a battery electrically connected to the light source;

wherein the light source projects an image on the ground;

wherein the interior housing unit is located within a shoe; and at least one slit on a side of the securing mechanism wherein the slit allows the securing mechanism to slightly expand a diameter of the securing mechanism to receive the interior housing unit.

* * * * *